US008739994B1

(12) United States Patent
Pritchett, Jr. et al.

(10) Patent No.: US 8,739,994 B1
(45) Date of Patent: Jun. 3, 2014

(54) CONTAINER AND BASE WITH DEFLECTABLE DOME

(71) Applicant: Graham Packaging Company, L.P., York, PA (US)

(72) Inventors: Raymond A. Pritchett, Jr., Manchester, PA (US); William W. Brecheisen, Findlay, OH (US); Mark P. Sprenkle, Manchester, PA (US); John P. Dinkel, York, PA (US); Matthew T. Gill, Hellam, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 13/797,659

(22) Filed: Mar. 12, 2013

(51) Int. Cl.
*B65D 1/02* (2006.01)
*B65D 79/00* (2006.01)

(52) U.S. Cl.
CPC ..... *B65D 1/0261* (2013.01); *B65D 79/005* (2013.01); *B65D 2301/20* (2013.01)
USPC ..... 215/373; 220/609; 220/608

(58) Field of Classification Search
CPC ... B65D 1/0261; B65D 1/0223; B65D 79/005
USPC ..... 220/609, 608, 606, 605, 604, 624, 623, 220/610, 600; 215/373, 372, 371, 370; D9/520
See application file for complete search history.

(56) References Cited

U.S. PATENT DOCUMENTS

| | | | | |
|---|---|---|---|---|
| 6,612,451 | B2 * | 9/2003 | Tobias et al. | 215/375 |
| 7,316,796 | B2 * | 1/2008 | Krohn et al. | 264/334 |
| 8,020,717 | B2 * | 9/2011 | Patel | 215/375 |

* cited by examiner

*Primary Examiner* — Robert J Hicks
(74) *Attorney, Agent, or Firm* — Baker Botts L.L.P.

(57) ABSTRACT

Base for a container, the base being made of polymeric material, including a support surface having an outer perimeter defining a first dimension along a major axis and a second dimension along a minor axis disposed approximately 90° from the major axis. An inner wall is coupled to the support surface opposite the outer perimeter. A dome projects upwardly from the inner wall and has an initial depth with respect to the support surface. The dome includes a major radius of curvature along the major axis and a minor radius of curvature along the minor axis. The dome is deflectable in response to a differential pressure across the base of at least 3.2 PSI without permanent deformation of the base.

31 Claims, 5 Drawing Sheets

CONTAINER AND BASE WITH DEFLECTABLE DOME

BACKGROUND OF THE DISCLOSED SUBJECT MATTER FIELD OF THE DISCLOSED SUBJECT MATTER

The disclosed subject matter relates to containers, and in particular, a base for a container having a deflectable dome to withstand internal pressure differential in excess of at least 3.2 PSI.

DESCRIPTION OF THE RELATED ART

Plastic containers are conveniently used to contain a wide variety of products. In the food industry, plastic containers are used to hold items in solid, granular or powder form, such as dry cereal, and in liquid form, such as juice and soda. During the process of filling such containers, the containers are sealed with a top closure such that a consumer can identify whether the container has been opened or tampered. When a container appears to be distorted in some manner, such as the top closure is opened or the container is bulging, the consumer generally refrains from purchasing or using such container. However, depending on an environment of the container, a sealed container can experience noticeable distortions even though the contents of the container remain untouched. For example, at elevations above or below sea level, the container may bulge and ultimately permanently deform due to variations in pressure. Additionally, if certain pressure differentials between the inside and the outside of the sealed container are exceeded, the base of the container can evert outwardly, resulting in unstable or unusable container and contents.

A number of functional improvements have been added to container designs to accommodate for the various thermal effects and pressures (positive and negative) in an effort to control, reduce or eliminate unwanted deformation. Ideally, such improvements are intended to make the package both visually appealing and functional for use. Functional improvements can include industry standard items such as vacuum panels to achieve the desired results. Generally, it is desirable that these functional improvements are minimal or hidden to achieve a specific shape, look or feel that is more appealing to the consumer. Additional requirements may also include the ability to make the container lighter in weight and more cost efficient by using less material. However, such lighter containers can make the container more susceptible to deformation.

Thus there is a need to develop an efficient and economic container and a base with specific characteristics to promote structural integrity of the container while experiencing different pressures or different environments. The presently disclosed subject matter satisfies these and other needs.

SUMMARY OF THE DISCLOSED SUBJECT MATTER

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes a base for a container made of polymeric material. The base comprises a support surface having an outer perimeter defining a first dimension along a major axis and a second dimension along a minor axis disposed approximately 90° from the major axis. The base further includes an inner wall coupled to the support surface opposite the outer perimeter, and a dome projecting upwardly from the inner wall. The dome has an initial depth with respect to the support surface. The dome is defined by a major radius of curvature along the major axis and a minor radius of curvature along the minor axis, wherein the dome is deflectable in response to a differential pressure across the base of at least 3.2 PSI without permanent deformation of the base.

In accordance with another aspect of the disclosed subject matter, a container is provided made of polymeric material, comprising a top portion defining a mouth; a sidewall portion coupled to the top portion opposite the mouth; and a base coupled to the sidewall portion opposite the top portion. The base includes a support surface having an outer perimeter defining a first dimension along a major axis of the base and a second dimension along a minor axis of the base, disposed approximately 90° from the major axis. The base further includes an inner wall coupled to the support surface opposite the outer perimeter, and a dome projecting upwardly from the inner wall. The dome has an initial depth with respect to the support surface. The dome is defined by a major radius of curvature along the major axis and a minor radius of curvature along the minor axis, wherein the dome is deflectable in response to a differential pressure across the base of at least 3.2 PSI without permanent deformation of the base.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to embodiments of the disclosed subject matter, an example of which is illustrated in the accompanying drawings. The disclosed subject matter will be described in conjunction with the detailed description of the system.

In accordance with the disclosed subject matter, a base for a container made of polymeric material. The base comprises a support surface having an outer perimeter defining a first dimension along a major axis and a second dimension along a minor axis disposed approximately 90° from the major axis. The base further includes an inner wall coupled to the support surface opposite the outer perimeter, and a dome projecting upwardly from the inner wall. The dome has an initial depth with respect to the support surface. The dome is defined by a major radius of curvature along the major axis and a minor radius of curvature along the minor axis, wherein the dome is deflectable in response to a differential pressure across the base of at least 3.2 PSI without permanent deformation of the base.

In accordance with another aspect of the disclosed subject matter, a container made of polymeric material is provided, wherein the container includes the base as summarized above. The container generally comprises a top portion defining a mouth; a sidewall portion coupled to the top portion opposite the mouth; and the base coupled to the sidewall portion opposite the top portion. As noted above, the base includes a support surface having an outer perimeter defining a first dimension along a major axis and a second dimension along a minor axis disposed approximately 90° from the major axis, and an inner wall coupled to the support surface opposite the outer perimeter. A dome projects upwardly from the inner wall and has an initial depth with respect to the support surface. The dome is defined by a major radius of curvature along the major axis and a minor radius of curvature along the minor axis, wherein the dome is deflectable in response to a differential pressure across the base of at least 3.2 PSI without permanent deformation of the base.

Figure 2:
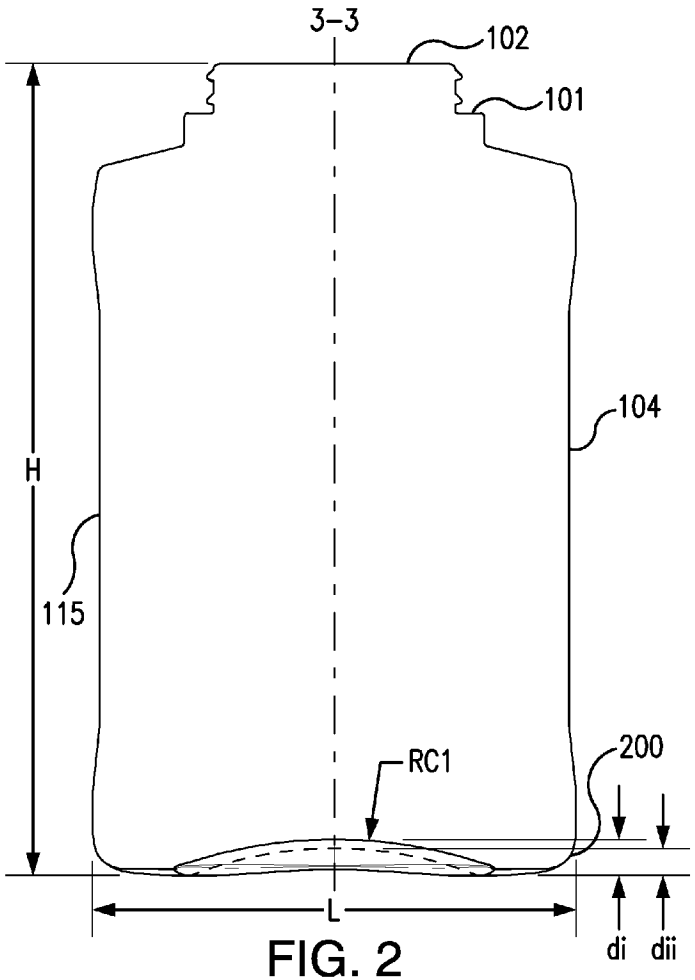
FIG. 2 is a cross-sectional front view of the representative container of FIG. 1 about lines 2-2, according to an embodiment of the disclosed subject matter.
Figure 1:
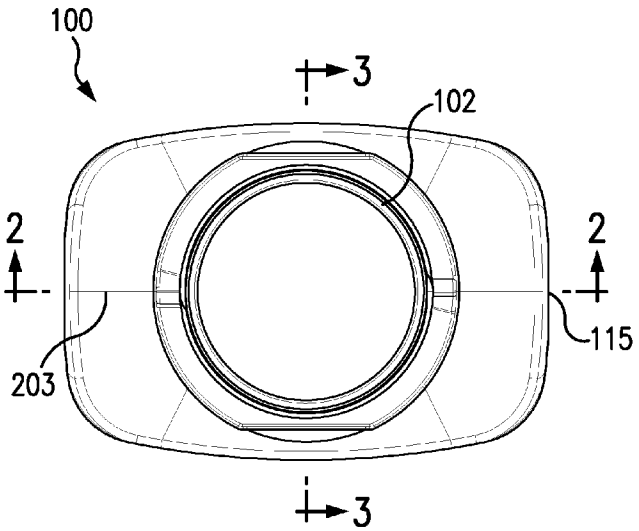
FIG. 1 is a top view of a representative container having a base in accordance with the disclosed subject matter.

For purpose of explanation and illustration, and not limitation, exemplary embodiments of the base and container with the disclosed subject matter are shown in the accompanying FIGS. 1-9. The base of the disclosed subject matter can be used with containers of a wide variety of shapes and configurations. For purpose of illustration, reference will be made to one representative embodiment of a container having a generally rectangular shape. FIGS. 1-5 illustrate exemplary embodiment or a representative container having the base of the disclosed subject matter. The examples herein are not intended to limit the scope of the disclosed subject matter in any manner. Particularly, and as illustrated, FIG. 1 is a top view of a container 100 made of polymeric material and FIG. 2 is a cross-sectional front view of the container of FIG. 1 taken about lines 2-2, according to an embodiment of the disclosed subject matter. As depicted, the container 100 generally includes a rectangular shape with an initial height H, width W, and length L. Other suitable shapes, such as for example, but not limited to, containers having square, circular, and elliptical cross-sectional shapes can be used with the base disclosed herein.

Depending on the purpose of the container, the container can be suitable sized to contain a plurality of different contents. For purpose of illustration only, reference is made to a container for food product in solid, granular, particle or powder form. The exemplary container has an initial height H of approximately 6 inches to 12 inches; a length L of approximately 3 to approximately 6 inches; and a width W of approximately 2 to approximately 4 inches. Such exemplary containers can be sized and shaped to contain a particular volume of, such as approximately 8 ounces or approximately 16 ounces of solid contents in particular form.

Figure 3:
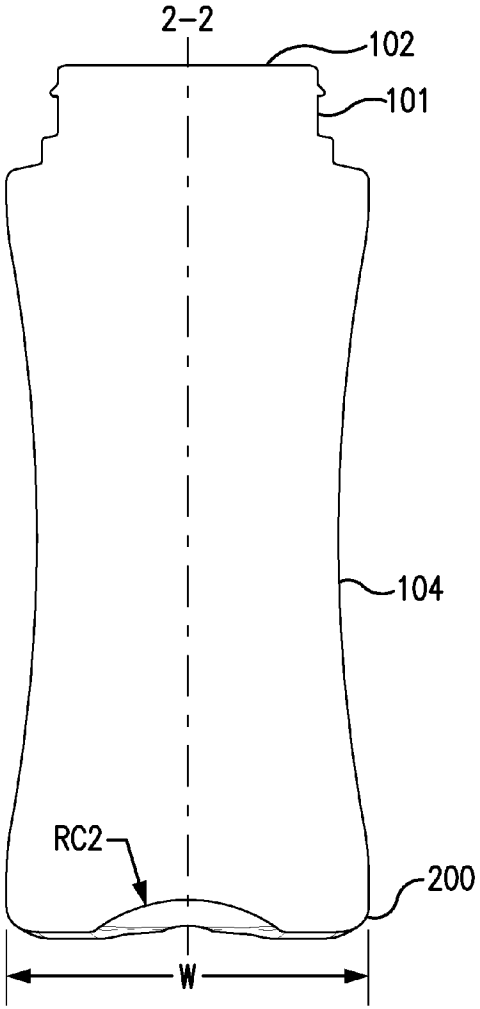
FIG. 3 is a cross-sectional side view of the representative container of FIG. 1 about lines 3-3, according to an embodiment of the disclosed subject matter.

As depicted in FIGS. 1-3, the container 100 generally includes a top portion 101, a mouth 102 and a sidewall portion 104 coupled to the top portion 101. The mouth can be formed of any suitable or desired configuration. The container can additionally include a cap and/or seal member (not shown), which can be monolithic with the container or formed as a separate member from the container. The cap and/or seal member can be compatible with the mouth and/or selectively engageable with the top portion of the container to selectively contain any contents within the container. As depicted, the sidewall portion 104 has a bowed configuration. Examples of suitable mouth and cap configurations are depicted in U.S. Pat. Nos. 8,020,717 and 6,612,451, which are incorporated by reference herewith in their entirety.

FIGS. 2 and 3 are cross-sectional front and side views of the container of FIG. 1 about lines 2-2 and 3-3, respectively. As shown in FIGS. 2 and 3, the sidewall portion 104 of the container does not necessarily have a uniform dimension. Rather, the sidewall portion 104 can be provided with a contoured shape, if desired. For example, the container embodied here is provided with a smaller perimeter dimension about a center region of the sidewall portion 104 in comparison with a perimeter dimension of the sidewall portion at the top and/or bottom regions of the container.

Figure 4:
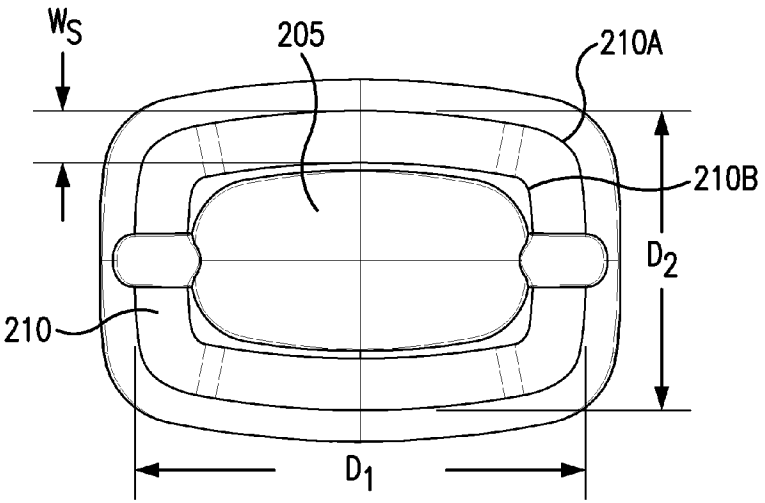
FIG. 4 is a bottom view of the representative container of FIG. 1, according to an embodiment of the disclosed subject matter.
Figure 5:
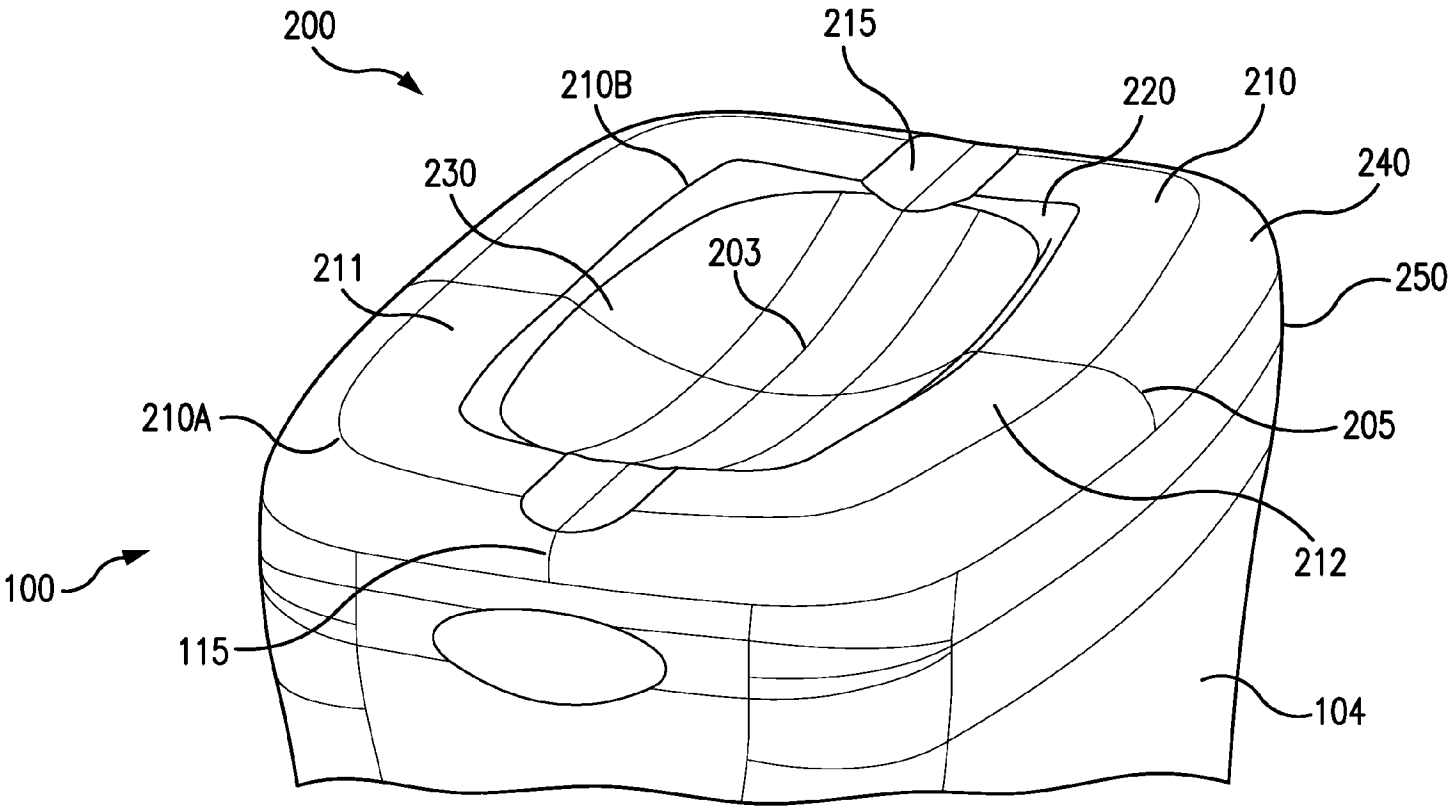
FIG. 5 is a perspective bottom view of a representative base for a container in accordance with the disclosed subject matter.

As noted above, and in accordance with the disclosed subject matter, a base is provided with a configuration to accommodate for a pressure differential across the base of at least 3.2 PSI without permanent deformation. That is, for purpose of understanding, the difference in pressure between the interior of the container and the exterior of the container can reach at least about 3.2 PSI without permanent deformation of the base. Such pressure differential can be due to a change in altitude and/or temperature, among other things. As illustrated in FIGS. 2-5, the container 100 representative herein further includes a base 200 coupled to the sidewall portion 104 opposite the top portion 101 of the container 100. FIG. 4 is a bottom view of the container of FIG. 1, whereas FIG. 5 is a perspective bottom view of an alternative embodiment of the base disclosed herein for purpose of understanding. As illustrated, the base 200 generally can be defined by a major axis 203 and a minor axis 205, which intersect at a vertical longitudinal center axis Z. Accordingly, the minor axis 205 can be disposed approximately 90° from the major axis. The base 200 includes a support surface 210 for the container. As depicted, the support surface 210 has an outer perimeter 210A and an inner perimeter 210B. The outer perimeter 210A defines a first dimension $D_1$ of the base along the major axis 203 and a second dimension $D_2$ of the base along the minor axis 205. The first and second dimensions $D_1$, $D_2$ can be any suitable dimension. For example, and as depicted herein, the first dimension of the support surface $D_1$ can be greater than the second dimension $D_2$ of the support surface. Other relationships between the first and second dimension are furthermore contemplated herein, such as for example, the second dimension can be generally equal to the first dimension of the support surface, as with a container having a square or circular cross-sectional shape or plan view.

As illustrated by FIG. 4, a width $W_S$ of the support surface 210 is defined between the outer perimeter 210A and the inner perimeter 210B of the support surface. The width $W_S$ of the support surface 210 can be any suitable dimension. For example, and with reference to the exemplary food container described above, the width $W_S$ can be between approximately 0.1 inches to approximately 0.8 inches. The support surface can have any suitable thickness, for example, a thickness of approximately 0.20 inches to 0.040 inches for the exemplary container herein.

In certain embodiments of the disclosed subject matter, the support surface can be a continuous surface about the base of the container. In other embodiments, the support surface can be discontinuous. For example and as illustrated in the embodiment of FIG. 5, the support surface 210 is a discontinuous surface about the base 200 of the container 100. The support surface 210 can include at least one contoured feature or tunnel 215 at a discontinuous section of the support surface. For purpose of illustration, the at least one tunnel 215 depicted herein is defined between a first portion 211 and a second portion 212 of the support surface 210 and the tunnel 215 extends upwardly toward the top portion of the container. In the representative embodiment of FIG. 5, the base 200 includes two tunnels 215 at discontinuous sections of the support surface, however, additional tunnels can be provided, as needed or desired. The at least one tunnel can be configured to be deflectable upwardly in response to pressure differential of the container without permanent deformation of the base, as further discussed herein. In another embodiment, the support surface can include downward projections, such as feet (not shown). Unlike the tunnels, the feet extend away from the top portion of the container.

Figure 9:
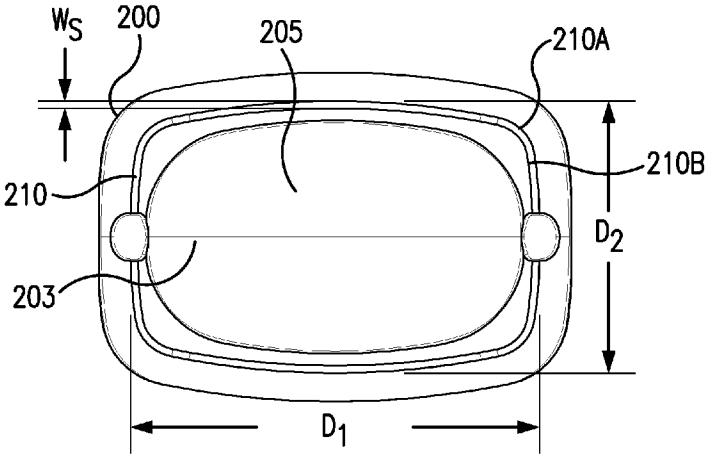
FIG. 9 is a bottom view of the representative container of FIG. 6, according to another embodiment of the disclosed subject matter.

The width $W_S$ of the support surface can be selected to provide a corresponding performance. For example, a larger width $W_S$ can be provided to facilitate flexing of the base 200 in response to a pressure differential across the base, as generally depicted in the representative embodiment to FIGS. 1-5. Alternatively, and as generally depicted in the representative embodiment of FIGS. 6-9, the width $W_S$ can be decreased to resist internal pressure and reduce flexing of the base. For purpose of illustration, but not limitation, FIGS. 6-9 illustrate another exemplary embodiment of a representative container having the base of the disclosed subject matter. In this embodiment, as best depicted in FIG. 9, the support surface 210 has smaller width $W_S$ than the support surface of the container of FIG. 4.

Further, in accordance with the disclosed subject matter and as illustrated in FIG. 5, the container 100 includes an inner wall 220 coupled to the support surface 210 opposite the outer perimeter 210A. The inner wall 220 can have a suitable angled configuration with respect to the support surface 220. As illustrated in FIG. 5, for example, the inner wall upwardly slopes toward the top portion of the container 100. The inner wall 220 thus can define a hinge joint to allow the inner wall 220 a degree of flexure relative to the support surface 210. The inner wall can further comprise an anti-inverting structure. The anti-inverting structure can maintain the upwardly sloping angled configuration of the inner wall 220 during variations of pressure external and internal to the container 100. As illustrated in FIG. 5, the width of the inner wall 220 varies with respect to inner perimeter 210B of the support surface 220. In other embodiments, the width of the inner wall 220 can be generally constant. Any suitable thickness, width, and dimension can be used for the inner wall, as described further below.

As noted above, the base of the disclosed subject matter has a dome projecting upwardly from the inner wall so as to be deflatable in response to a pressure differential across the base of at least 3.2 PSI without permanent deformation. With reference to FIG. 5, the dome 230 projects upwardly from the inner wall 220. The dome 230 is defined by at least one radius of curvature. In the representative embodiment of FIGS. 1-4, the dome 230 includes two different radii of curvature. For example, FIG. 2 shows the dome 230 defined by a first radius of curvature $R_{C1}$ along the major axis 203, while FIG. 3 shows the dome 230 further defined by a second radius of curvature $R_{C2}$ along the minor axis 205. In this embodiment, the major radius of curvature $R_{C1}$ is greater than the minor radius of curvature $R_{C2}$. Other relationships between the major radius of curvature and the minor radius of curvature are further contemplated herein, such as the minor radius of curvature being generally equal to or greater than the major radius of curvature. As embodied herein, the major radius of curvature $R_{C1}$ is approximately 2 to approximately 4 times greater than the minor radius of curvature $R_{C2}$.

As illustrated in FIG. 2, the dome 230 has an initial depth $d_i$ with respect to the support surface 220. The initial depth $d_i$ of the dome can have any suitable dimension depending upon the dimensions of the support surface and base. For example, and with reference to the exemplary food container above, the initial depth of the dome can be between approximately 0.30 inches to approximately 0.60 inches and more particularly, be between approximately 0.40 inches to approximately 0.50 inches.

In accordance with the disclosed subject matter, however, the initial depth $d_i$ of the dome has a selected dimensional relationship with at least one other feature of the base 200 or container 100. For example, and in accordance with another aspect of the disclosed subject matter, the initial depth $d_i$ can have a dimensional relationship with at least one or both of the first dimension $D_1$ and the second dimension $D_2$ of the support surface 220. As embodied herein, the initial depth $d_1$ can be between approximately 8 percent to approximately 15 percent of the first dimension $D_1$ of the support surface 220. Additionally, the dome of the base embodied herein has the initial depth $d_1$ of the dome 230 can be between approximately 12 percent to approximately 24 percent of the second dimension $D_2$, and particularly the initial depth $d_i$ of the dome 230 can be between approximately 15 percent to approximately 22 percent of the second dimension $D_2$.

Additionally or alternatively, and in accordance with another aspect of the disclosed subject matter, the initial depth $d_i$ can have dimensional relationships with the major and/or minor radii of curvature $R_{C1}$, $R_{C2}$ of the dome 230. For example, and as embodied herein, the initial depth $d_i$ can be between approximately 5 percent to approximately 10 percent of the major radius of curvature $R_{C1}$. Additionally, the initial depth $d_i$ can be between approximately 14 percent to approximately 28 percent of the minor radius of curvature $R_{C2}$, and in particular, the initial depth $d_i$ can be between approximately 18 percent to approximately 24 percent of the minor radius of curvature $R_{C2}$.

Figure 7:
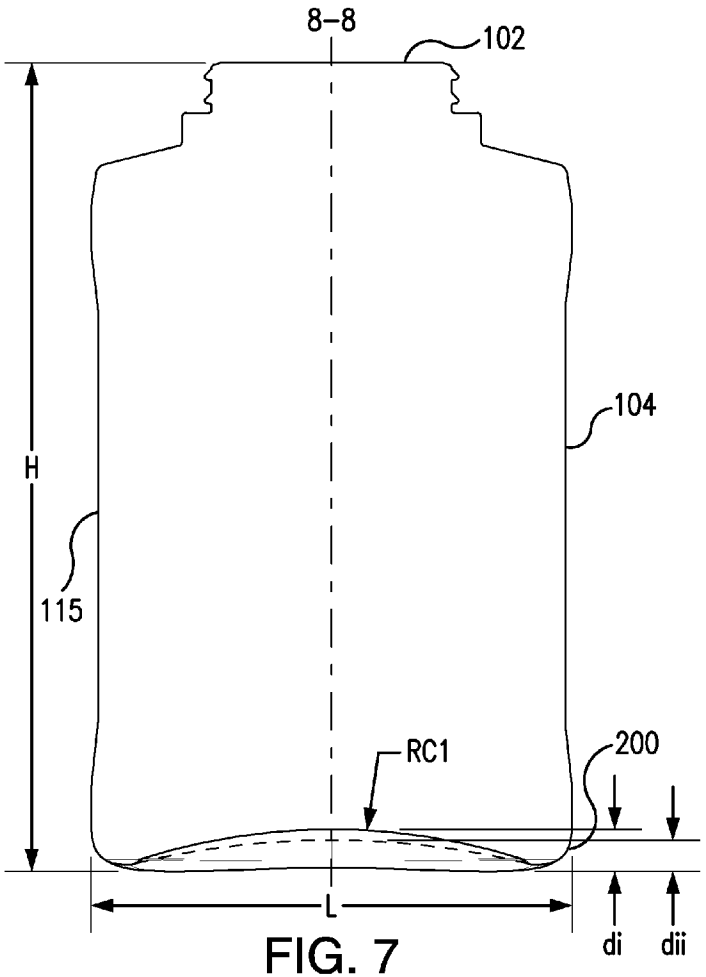
FIG. 7 is a cross-sectional front view of the representative container of FIG. 6 about lines 7-7, according to another embodiment of the disclosed subject matter.
Figure 6:
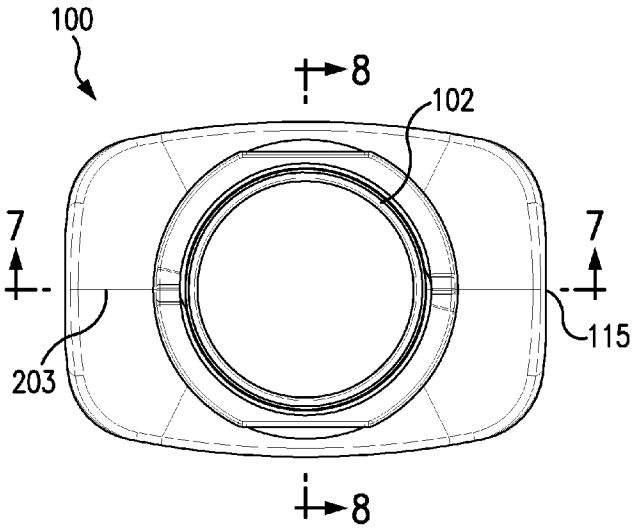
FIG. 6 is a top view of a representative container having a base in accordance with another embodiment of the disclosed subject matter.
Figure 8:
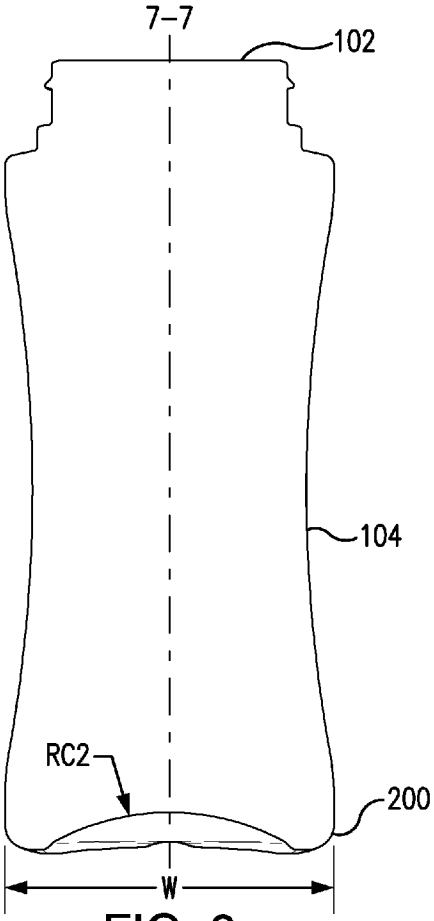
FIG. 8 is a cross-sectional side view of the representative container of FIG. 6 about lines 8-8, according to another embodiment of the disclosed subject matter.

For purposes of illustration, FIG. 7 depicts a base 200 having an initial depth $d_i$ that is greater than the initial depth of the embodiment of FIG. 2. As apparent by the embodiment of FIGS. 6-9, the increased dimension of the initial depth has a structural impact on other components of the container, in comparison with the container of FIGS. 1-5. For example and as best depicted by FIG. 7 and FIG. 8, the dimension of the first radius of curvature $R_{C1}$ and the dimension of the second radius of curvature $R_{c2}$ are respectively greater in comparison with the container of FIGS. 1-5. In addition, as previously discussed, the width of the support surface Ws of the embodiment of FIGS. 6-9 is less than the width of the support surface Ws of the embodiment of FIGS. 1-5.

The structure of the container can accommodate for pressure variations to prevent deformation. For example, the container can include structural improvements such as but not limited to, ribs and vacuum panels to achieve the desired results as those structural improvements described in, U.S. Pat. No. 6,612,451, the contents of which are incorporated by reference in their entirety.

As previously noted, containers can experience a wide range of pressures internal and/or external to the container, depending on the environment in which the container is exposed and manner used. For example, the container will experience variations in pressure at different elevations above or below sea level. According to the disclosed subject matter, the dome is therefore deflectable in response to a differential pressure across the base of at least 3.2 PSI without permanent deformation of the base. In fact, and with reference to the exemplary container referenced above, the dome has been determined to be deflectable in response to a differential pressure across the base of at least 5.5 PSI or greater without permanent deformation of the base. As such and as illustrated in FIG. 2, at certain pressures, the depth of the dome 230 can change from the initial depth $d_i$ to a second depth $d_{ii}$. The deflection of the dome 230 permits the container 100 to maintain its structural integrity without permanent deformation of the container 100. For example, and with reference to a representative container as depicted in FIGS. 1-5 and having an 8 ounce capacity, the dome can deflect up to approximately 0.30 inches at a pressure deflection across the base of about 5.8 PSI without permanent deflection. Additionally, and with reference to a representative container as depicted in FIGS. 6-9 having an 8 ounce capacity, the dome can deflect up to approximately 0.35 inches at a pressure deflection across the base of about 5.8 PSI without permanent deflection. In yet another example, with reference to a representative container as depicted in FIGS. 1-5 and having a 16 ounce capacity, the dome can deflect up to approximately 0.34 inches at a pressure deflection across the base of about 5.8 PSI without permanent deflection. In another embodiment as depicted in FIGS. 6-9 and having a 16 ounce capacity, the dome can deflect up to approximately 0.45 inches at a pressure deflection across the base of about 5.8 PSI without permanent deflection. Additional details regarding these containers are set forth in Table 1 and Table 2, respectively. In this manner, the base and container of the disclosed subject matter can accommodate elevations at least up to approximately 7,000 feet without permanent deformation.

TABLE 1

| Embodiment | FIG. 1-5 | FIG. 1-5 |
|---|---|---|
| Capacity | 8 ounces | 16 ounces |
| Length (L) | 4.02 inches | 5.05 inches |
| Width (W) | 2.8 inches | 3.2 inches |
| Initial Depth (Di) | 0.3 inches | 0.34 inches |
| Major Radius of Curvature (RC1) | 3.92 inches | 6.50 inches |

TABLE 1-continued

| Embodiment | FIG. 1-5 | FIG. 1-5 |
|---|---|---|
| Minor Radius of Curvature (RC2) | 1.21 inches | 1.36 inches |
| Support Surface WIdth (Ws) | 0.4 inches | 0.4 inches |
| First Dimension (D1) | 3.49 inches | 4.37 inches |
| Second Dimension (D2) | 2.31 inches | 2.58 inches |
| Material of Construction | HDPE | HDPE |
| Pressure Deflection | 5.8 PSI | 5.8 PSI |

TABLE 2

| Embodiment | FIG. 6-9 | FIG. 6-9 |
|---|---|---|
| Capacity | 8 ounces | 16 ounces |
| Length (L) | 4.02 inches | 5.05 inches |
| Width (W) | 2.8 inches | 3.2 inches |
| Initial Depth (Di) | 0.35 inches | 0.45 inches |
| Major Radius of Curvature (RC1) | 5.22 inches | 6.37 inches |
| Minor Radius of Curvature (RC2) | 2.06 inches | 2.13 inches |
| Support Surface WIdth (Ws) | 0.06 inches | 0.06 inches |
| First Dimension (D1) | 3.48 inches | 4.36 inches |
| Second Dimension (D2) | 2.31 inches | 2.58 inches |
| Material of Construction | HDPE | HDPE |
| Pressure Deflection | 5.8 PSI | 5.8 PSI |

With reference again to FIG. 5, the base 200 can additionally comprise a heel radius 240 extending from the outer perimeter 210B of the support surface 210. Thus, the support surface 210 can be coupled to the heel radius 240 along the outer perimeter 210B. The heel radius 240 can be centered with respect to a vertical axis Z of the base 200. As illustrated, a bumper 250 can extend from the heel radius 240 to form a bottom edge of the base. The heel radius and/or the bumper can include any suitable shape, and radius or dimension. Additionally, the heel radius and/or bumper can be disposed between and coupled the support surface with the outer wall of the container. The heel radius and/or the bumper thus can correspond to the shape of the container. For example, and as shown in FIG. 5, the heel radius and/or the bumper are both approximately rectangular in shape in plan view.

The container can be manufactured by any of a number of suitable methods, as known in the art. In embodiments with a parting line present, the parting line is formed through the manufacturing of the container by way of conventional blow molding techniques such as with a split mold, but other suitable techniques are furthermore contemplated herein as known in the art. For example, and as embodied herein, the container and integral base can be manufactured by blow molding technique as known in the art, and also as described in U.S. Pat. No. 7,316,796, the contents of which are incorporated by reference in its entirety. In this manner, the container and base can be blow molded with a split mold to create a parting line along line 2-2 as shown in FIG. 1. Here, and as illustrated in FIG. 1 and FIG. 2, the container 100 can additionally comprise a seam or parting line 115 defined along one of the axes, e.g., the major axis 203 as shown. The parting line 115, when present, divides the container 100 into first and second halves about the major axis 203. As embodied herein, the container 100 can be approximately structurally symmetrical about the major axis 203.

The container and the base can comprise any suitable thickness and can comprise a plurality of suitable materials. In one embodiment, the container and base are formed of a polymeric material, such as for example but not limited to, high-density polyethylene (HDPE). In other embodiments, the container and base can be formed from materials including, but not limited to, polyethylene terephthalate (PET), polyethylene naphthalate (PEN) and PEN-blends, polypropylene (PP), high-density polyethylene (HDPE), and can also include monolayer blended scavengers or other catalytic scavengers as well as multi-layer structures including discrete layers of a barrier material, such as nylon or ethylene vinyl alcohol (EVOH) or other oxygen scavengers. The container can further include a lining on the interior and/or exterior of the container.

Furthermore, the container of the discussed subject matter, will have a suitable material of construction and thickness for the intended contents of the container. For example, and as embodied herein, the container can have a substantially similar thickness from the top portion of the container through the sidewall and a slightly greater thickness at the base of the container. With reference to the exemplary food containers above, the container can be made of HDPE, wherein the dome of the base has a thickness of approximately 0.030 inches to approximately 0.100 inches.

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the disclosed subject matter without departing from the spirit or scope of the disclosed subject matter. Thus, it is intended that the disclosed subject matter include modifications and variations that are within the scope of the appended claims and their equivalents.

What is claimed is:

1. A base for a container, the base being made of polymeric material, comprising:

a support surface having an outer perimeter defining a first dimension along a major axis and a second dimension along a minor axis disposed approximately 90° from the major axis;

an inner wall coupled to the support surface opposite the outer perimeter; and a dome projecting upwardly from the inner wall and having an initial depth with respect to the support surface, the dome is defined by a major radius of curvature along the major axis and a minor radius of curvature along the minor axis, wherein the dome is deflectable in response to a differential pressure across the base of at least 3.2 PSI without permanent deformation of the base.

2. The base according to claim 1, wherein the initial depth of the dome is between approximately 8 percent to approximately 15 percent of the first dimension.

3. The base according to claim 1, wherein the initial depth of the dome is between approximately 12 percent to approximately 24 percent of the second dimension.

4. The base according to claim 3, wherein the initial depth of the dome is between approximately 15 percent to approximately 22 percent of the second dimension.

5. The base according to claim 1, wherein the initial depth of the dome is between approximately 5 percent to approximately 10 percent of the major radius of curvature.

6. The base according to claim 1, wherein the initial depth of the dome is between approximately 14 percent to approximately 28 percent of the minor radius of curvature.

7. The base according to claim 1, wherein the initial depth of the dome is between approximately 8 percent to approximately 15 percent of the first dimension, wherein the initial depth of the dome is between approximately 12 percent to approximately 24 percent of the second dimension, wherein the initial depth of the dome is between approximately 5 percent to approximately 10 percent of the major radius of curvature, and wherein the initial depth of the dome is between approximately 14 percent to approximately 28 percent of the minor radius of curvature.

8. The base according to claim 1, wherein the initial depth of the dome is between approximately 0.30 inches to approximately 0.60 inches.

9. The base according to claim 8, wherein the initial depth of the dome is between approximately 0.40 inches to approximately 0.50 inches.

10. The base according to claim 1, wherein the dome is deflectable in response to a differential pressure across the base of at least 5.5 PSI without permanent deformation of the base.

11. The base according to claim 1, wherein the dome can deflect up to approximately 0.40 inches without permanent deflection.

12. The base according to claim 1, wherein the dome has a thickness of approximately 0.030 inches to approximately 0.100 inches.

13. The base according to claim 1, wherein the major radius of curvature is greater than the minor radius of curvature.

14. The base according to claim 13, wherein the major radius of curvature is approximately 2 to approximately 4 times greater than the minor radius of curvature.

15. The base according to claim 1, further comprising a parting line defined along the major axis.

16. The base according to claim 1, wherein the first dimension of the support surface is greater than the second dimension of the support surface.

17. The base according to claim 1, wherein the support surface further includes a width defined between the outer perimeter and an inner perimeter of the support surface.

18. The base according to claim 17, wherein the width of the support surface is between approximately 0.1 inches to approximately 0.8 inches.

19. The base according to claim 1, wherein a thickness of support surface is approximately 0.20 inches to 0.40 inches.

20. The base according to claim 1, wherein the support surface is discontinuous with at least one tunnel defined between a first portion and a second portion of the support surface.

21. The base according to claim 20, wherein the at least one tunnel is deflectable upwardly in response to the differential in pressure without permanent deformation.

22. The base according to claim 1, wherein the inner wall comprises a hinge joint.

23. The base according to claim 1, wherein the inner wall comprises an anti-inverting structure.

24. The base according to claim 1, further comprising a heel radius extending from the outer perimeter of the support surface, the heel radius centered with respect to a vertical axis of the base.

25. The base according to claim 24, further comprising a bumper extending from the heel radius.

26. The base according to claim 25, wherein the bumper comprises at least one of a square, rectangle, or round shape.

27. The base according to claim 24, wherein the support surface is coupled to the heel radius opposite the outer perimeter.

28. The base according to claim 1, wherein the polymeric material of the base includes HDPE.

29. The base according to claim 28, wherein the base is blow molded.

30. A container made of polymeric material, comprising:

a top portion defining a mouth;

a sidewall portion coupled to the top portion; and a base coupled to the sidewall portion opposite the top portion, the base including a support surface having an outer perimeter defining a first dimension along a major axis and a second dimension along a minor axis disposed approximately 90° from the major axis, an inner wall coupled to the support surface opposite the outer perimeter, and a dome projecting upwardly from the inner wall and having an initial depth with respect to the support surface, the dome comprising a major radius of curvature along the major axis and a minor radius of curvature along the minor axis, wherein the dome is deflectable in response to a differential pressure across the base of at least 3.2 PSI without permanent deformation of the base.

31. The container according to claim 30, wherein the initial depth of the dome is between approximately 8 percent to approximately 15 percent of the first dimension, wherein the initial depth of the dome is between approximately 12 percent to approximately 24 percent of the second dimension, wherein the initial depth of the dome is between approximately 5 percent to approximately 10 percent of the major radius of curvature, and wherein the initial depth of the dome is between approximately 14 percent to approximately 28 percent of the minor radius of curvature.

* * * * *